United States Patent [19]

Eguchi et al.

[11] 4,429,649

[45] Feb. 7, 1984

[54] ASSEMBLY FOR LOWER THREAD TENSION ADJUSTMENT OF SEWING MACHINE

[75] Inventors: Yasukata Eguchi, Kunitachi; Eiichi Shomura, Hachioji, both of Japan

[73] Assignee: Janome Sewing Machine Industry Co., Ltd., Japan

[21] Appl. No.: 305,802

[22] Filed: Sep. 25, 1981

[30] Foreign Application Priority Data

Sep. 26, 1980 [JP] Japan ..... 55-136050[U]

[51] Int. Cl.³ ..... D05B 63/00

[52] U.S. Cl. ..... 112/229; 112/233; 112/254

[58] Field of Search ..... 112/59, 184, 229, 231, 112/233, 254

[56] References Cited

U.S. PATENT DOCUMENTS

| | | | |
|---|---|---|---|
| 845,092 | 2/1907 | Jacob et al. | 112/184 X |
| 2,034,506 | 3/1936 | Colegrove et al. | 112/231 |
| 3,856,233 | 12/1974 | Thomas | 112/254 X |
| 4,202,286 | 5/1980 | Costas | 112/254 X |
| 4,301,978 | 11/1981 | Herr et al. | 112/254 X |

FOREIGN PATENT DOCUMENTS

| | | | |
|---|---|---|---|
| 1068094 | 10/1959 | Fed. Rep. of Germany | 112/229 |
| 353970 | 6/1961 | Switzerland | 112/254 |
| 747528 | 4/1956 | United Kingdom | 112/231 |

*Primary Examiner*—Wm. Carter Reynolds
*Attorney, Agent, or Firm*—William A. Drucker

[57] ABSTRACT

An assembly for adjustment of lower thread tension for a sewing machine having a loop taker and a bobbin carrier which is held by the loop taker and carries a bobbin loaded with the lower thread. The assembly comprises a base plate and a resilient member, one end of which is connected to the base plate. A tension is given to the lower thread while the thread is passed between the base plate and the resilient member. A substantially L-shaped presser element having an upper vertical and a lower horizontal portion is provided for the assembly and is turnably attached to an inner wall of the bobbin carrier. The vertical portion of the presser element is adapted to press a free end of the resilient member against the base plate. A permanent magnet or electromagnet acts on the horizontal portion of the presser element without contact thereto. The magnet is manually operated from outside of the sewing machine to vary a magnetic force of the magnet against the horizontal portion of the presser element, upon which the presser element is turned to adjust the lower thread tension. The resilient member may be omitted and in this case the L-shaped presser element is designed to directly press the lower thread against the base plate.

5 Claims, 8 Drawing Figures

ASSEMBLY FOR LOWER THREAD TENSION ADJUSTMENT OF SEWING MACHINE

BACKGROUND OF THE INVENTION

The invention relates to a lower thread tension adjusting device of a sewing machine having a loop taker which is rotated in a horizontal plane to catch a thread loop formed at the needle as the latter goes up from the lower dead point thereof during a fabric stitching operation. The device of the invention is so designed as to enable the sewing machine operator to adjust the lower thread tension from outside of the sewing machine in reference to indices even while driving the sewing machine.

When a fabric is sewn with a sewing machine, it is generally required to determine an upper thread tension in dependence upon a kind or thickness of the fabric to be sewn, and accordingly it becomes necessary to adjust a lower thread tension to be balanced with the determined upper thread tension. Hitherto, the lower thread tension has been adjusted by manipulation of an adjusting screw, after once interrupting the stitching operation, removing a needle plate and then taking out a bobbin carrier from a loop taker. More particularly, in reference to FIG. 1, the conventional lower thread adjusting device 4 is composed of an arcuate base plate 1 secured to an inner wall of a bobbin carrier 5 which carries a bobbin 7 loaded with a lower thread 8, a resilient plate 2 secured at one end thereof to the arcuate plate 1, and an adjusting screw 3 passed through the resilient plate 2 and screwed into the arcuate base plate 1. The bobbin carrier 5 is received in a loop taker 6 and is kept stationary while the loop taker 6 is rotated on a vertical shaft 6*a*. As shown, the arcuate base plate 1 is formed with an inclined slit 1*a* and has a cutout 1*b* formed on the upper edge thereof on the left side of the inclined slit 1*a*. The lower thread 8 supplied from the bobbin 7 is inserted down into the inclined slit (1*a*) and guided up between the arcuate base plate 1 and the resilient plate 2 and is passed through the cutout 1*b* up to the needle plate (not shown). Thus, the lower thread 8 is pressed between the arcuate base plate 1 and the resilient plate 2 and has a tension due to the frictional resistance. In order to vary the lower thread tension, the adjusting screw 3 is fastened or loosened to vary the pressure of the resilient plate 2 applied to the lower thread 8. For manipulation of the adjusting screw 3, it is unavoidable according to the conventional device, to once interrupt the stitching operation of the sewing machine and to take the bobbin carrier 5 out of the loop taker 6. Moreover it is very difficult and time consuming to properly determine the lower thread tension because the tension adjustment has to be carried out by a guess-work, which often requires the readjustments of the adjusting screw 3.

SUMMARY OF THE INVENTION

The invention has been provided to eliminate the defects and disadvantages of the prior art. It is therefore an object of the invention to provide an improved assembly for adjusting a lower thread tension with convenience even while driving a sewing machine.

It is another object of the invention to facilitate a rapid and accurate adjustment of the lower thread tension of the sewing machine.

It is still another object of the invention to provide an improved lower thread tension adjusting assembly which is simple in structure and easy in operation.

For attaining these objects, the invention is to provide an assembly for adjusting a lower thread tension for use in combination with a sewing machine having a loop taker and a bobbin carrier which is held by the loop taker and carries therein a bobbin loaded with a lower thread, said assembly comprising (a) a base plate attached to an inner wall of the bobbin carrier and provided with a slit through which the lower thread passes;

(b) a substantially L-shaped presser element having a vertical portion and a horizontal portion, the vertical portion being adapted to be normally pressed against the base plate so as to give a tension to the lower thread passing through the slit;

(c) means for turnably supporting the L-shaped presser element with respect to the base plate;

(d) magnetic means acting on the horizontal portion of the L-shaped presser element without contact thereto for turning the L-shaped presser element; and (e) means for manually operating the magnetic means to vary a magnetic force of the magnetic means with respect to the horizontal portion of the L-shaped presser element.

Another aspect of the invention is to provide an assembly for adjusting a lower thread tension for use in combination with a sewing machine having a loop taker and a bobbin carrier which is held by the loop taker and carries therein a bobbin loaded with a lower thread, said assembly comprising (a) a base plate attached to an inner wall of the bobbin carrier and provided with a slit through which the lower thread passes;

(b) a resilient member secured to the base plate and being resiliently in contact with the base plate to give a tension to the lower thread passing through the slit;

(c) a substantially L-shaped presser element having a vertical portion and a horizontal portion, the vertical portion being adapted to press the resilient member against the base plate;

(d) means for turnably supporting the L-shaped presser element with respect to the base plate;

(e) magnetic means acting on the horizontal portion of the L-shaped presser element without contact thereto for turning the L-shaped presser element; and (f) means for manually operating the magnetic means to vary a magnetic force of the magnetic means with respect to the horizontal portion of the L-shaped presser element.

BRIEF DESCRIPTION OF DRAWINGS

Further objects and advantages of the invention can be fully understood from the following detailed description when read in conjunction with the accompanied drawings, in which.

PREFERRED EMBODIMENTS OF THE INVENTION

Figure 1:
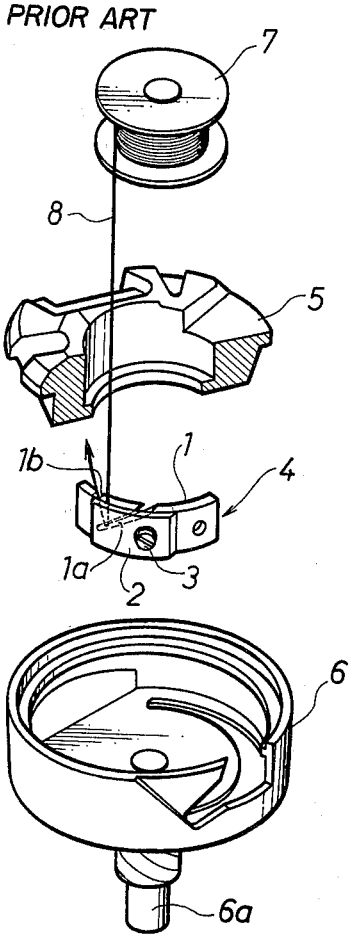
FIG. 1 PRIOR ART
FIG. 1 is an exploded perspective view, partly in section, showing a prior art assembly for adjustment of bobbin thread tension.

Some preferred embodiments of the invention are shown in FIGS. 2 through 8 which have the same parts with those of the prior art as shown in FIG. 1. These parts are indicated by the same reference numbers and already explained in the introduction of the specification, and therefore the detail explanation of these parts is not repeated herein.

Figure 2:
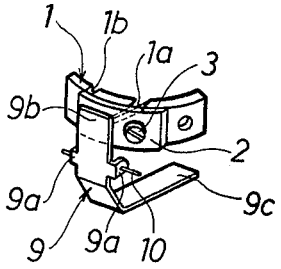
FIG. 2 is a perspective view showing a state of essential elements of bobbin thread tension adjusting assembly of the invention.
Figure 3:
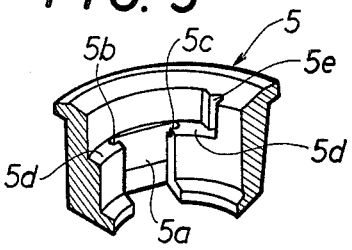
FIG. 3 is a perspective view, partly in section, showing a structure of inner wall of a bobbin carrier of the invention.

Referring specifically to FIG. 2, a substantially L-shaped presser element 9, which is made of a magnet responsive substance, is supported on a pin 10 which is passed through opposite ears 9*a*, 9*a* formed at upper part of the presser element 9, so that the element 9 is turnable around the pin 10. Both ends of the pin 10 are inserted into opposite grooves 5*b*, 5*c* respectively formed on steps 5*d*, 5*d* located on both sides of a recess 5*a* of inner wall of a bobbin carrier 5 as shown in FIG. 3.

Figure 4:
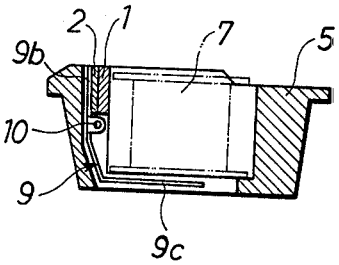
FIGS. 4 and 5 are a sectional and a plan view showing the bobbin thread tension adjusting assembly of the invention which is attached to the bobbin carrier.
Figure 5:
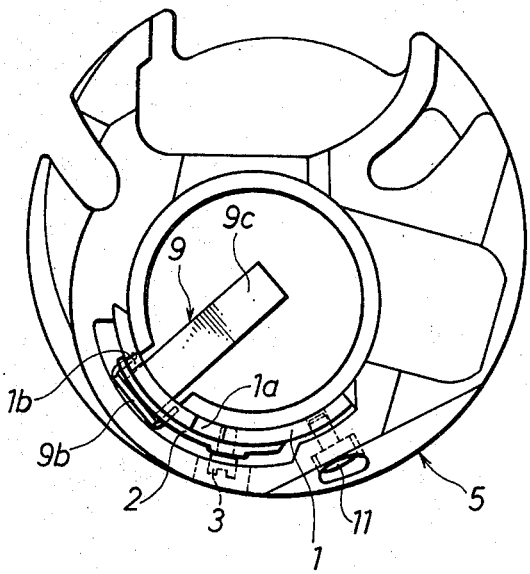

A base plate (1) is at its one end secured to the inner wall of the bobbin carrier (5) by a connecting means such as a screw (11) as shown in FIG. 5. The other end of the base plate (1) is inserted into a notch (5*e*) formed on the end of one of the steps 5*d* as shown in FIG. 3. Thus, the base plate is fixedly mounted on the bobbin carrier (5). In this manner, as shown in FIGS. 4 and 5, the presser element 9 has the upper vertical portion 9*b* located beteen the inner wall of the bobbin carrier 5 and the resilient plate 2 and has the lower bent portion 9*c* extending through the cutout 5*a* to the bottom across the bobbin carrier 5. A resilient plate (2) is at its one end secured to the base plate (1) by a fastening means (3). In this invention, however, the fastening means (3) is simply employed for this purpose and gives no influence to adjustment of the lower thread tension.

More particularly in reference to FIG. 5, the loop taker 6 is rotated around a hollow vertical shaft 15 having an axial bore 15*a* extended therethrough and secured to a seat 13 by a fastening screw 14. The loop taker 6 has a vertical gear 12 which is operatively connected to a lower shaft of a sewing machine (not shown) so as to be rotated with the latter. A rod 16 is inserted into the vertical bore 15*a* of the shaft (15) and is vertically movable. The rod 16 has a flange 16*a* provided at the top thereof which is located in a chamber 6*b* defined below the bottom 6*c* of the loop taker 6. A permanent magnet 17 is mounted on the flange 16*a* as shown.

Figure 6:
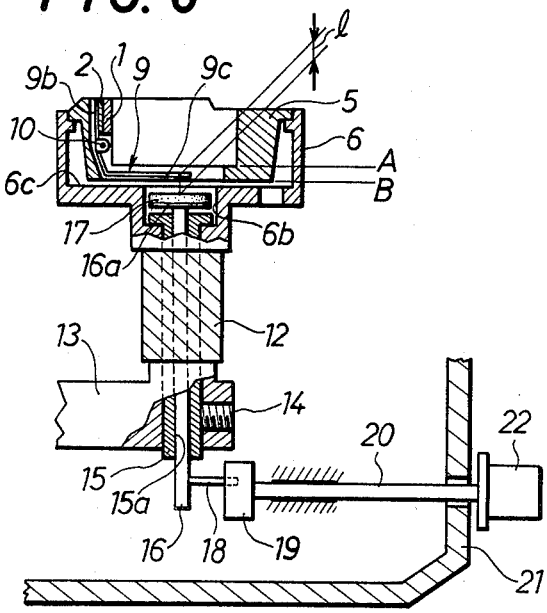
FIG. 6 is a sectional view showing the whole part of one embodiment according to the invention.

As shown in FIG. 6, the vertical rod 16 has a transverse pin 18 secured to the lower end thereof. The transverse pin 18 is in engagement with a grooved cam 19 which is secured to an inner end of a transverse operating rod 20. The operating rod 20 has the other end protruded out of a machine housing 21. A knob 22 is secured to the protruded end of the operating rod 21.

The above-structured embodiment of the lower thread tension adjusting assembly according to the invention is operated as follows; When the knob 22 is turned in one or the opposite direction, the transverse rod 20 is accordingly turned. The vertical rod 16 is therefore vertically moved by way of the transverse pin 18 which is under the control of the grooved cam 19. Thus the permanent magnet 17 is moved in the direction toward or away from the lower horizontal portion 9*c* of the presser element 9, and the distance l between the magnet 17 and the portion 9*c* is selectively determined. In dependence upon the distance l, the attracting force of the permanent magnet 17 is varied with respect to the lower portion 9*c* of presser element 9. It is therefore apparent that the L-shaped presser element 9 is displaced in the clockwise or counterclockwise direction around the pivot pin 10 in dependence upon the distance l, and accordingly the pressure of the upper portion 9*b* of the presser element 9 is varied against the resilient plate 2 on the arcuate base plate 1. Thus a desired tension may be applied to the lower thread guided through between the resilient plate 2 and the base plate 1.

According to the invention, although the lower thread tension is adjusted by turning the L-shaped presser element (9) in the manner just described, a possible vertical movement of the lower horizontal portion (9*c*) of the presser element (9) is limited. More particularly, the lower portion (9*c*) is prevented from moving beyond the level A, that is the bottom of the bobbin (7), so that the rotation of the bobbin (7) is not interfered, and is prevented from coming to the lower level B, that is the bottom of the bobbin carrier (5), so that an upper thread loop is drawn out between the bottom (6*c*) of the loop taker (6) and the bottom of the bobbin carrier (5) without interruption due to plate 2 and carrier 5. Thus, the lower horizontal portion (9*c*) of the presser element (9) is so designed as to vertically move in a limited range between the upper level A and the lower level B.

According to the embodiment, the grooved cam 19 is so designed as to limit the vertical movement of permanent magnet 17 to the lowest and uppermost positions. The magnet 17 is prevented from coming to a level above the bottom 6*c* of the loop taker 6, so that the upper thread loop may be drawn out of the loop taker 6 through a clearance between the level B and the bottom 6*c*. In order to optionally and accurately adjust the lower thread tension, a reference mark is preferably provided on the housing 21 at a position adjacent to the knob 22, and indices are provided on the knob each to be identified in relation to the reference mark on the housing for the purpose of defining the angular positions of operating rod 20, i.e., the degrees of tension to be applied to the lower thread.

Figure 7:
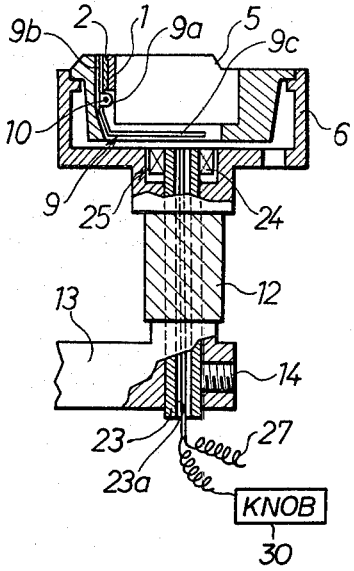
FIG. 7 is a sectional view showing another embodiment of the invention.

FIG. 7 shows another embodiment of the invention which employs an electromagnet 25 including a winding 24, instead of the permanent magnet 17 used in the first embodiment shown in FIG. 6. The electromagnet 25 is mounted on a top of a vertical hollow shaft 23 about which the loop taker 6 is rotated. Leads 26, 27 are drawn out from the winding 24 through an axial bore 23*a* of the vertical shaft 23, so as to control the electric current flowing through the winding 24 by way of a knob 30, thereby varying the electromotive force of the electromagnet 25. Thus the attracting force of the electromagnet 25 is varied with respect to the L-shaped presser element 9, and accordingly the degree of tension is varied to be applied to the bobbin thread. In this case, it is also preferable to provide indices on the knob which are to be identified in relation to a reference mark provided on the machine housing for the purpose of defining the electromotive force of the electromagnet 25, i.e., a desired degree of tension to be applied to the bobbin thread.

Figure 8:
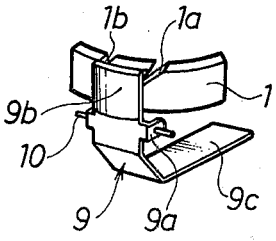
FIG. 8 is a perspective view showing still another embodiment of the invention.

FIG. 8 shows a modification of the embodiment of FIG. 2 wherein the resilient plate (2) is not employed and the L-shaped presser element (9) is designed to directly press the lower thread against the base plate 1. In this case, the upper vertical portion (9*b*) of the presser element (9) preferably has a sufficient face which is arcuated in accordance with the face of the arcuate base plate 1 to effectively press the lower thread against the latter. The L-shaped presser element (9) is operated by mechanism such as shown in FIG. 6 or 7 to adjust the lower thread tension.

As many different embodiments of the invention may be made without departing from the spirit and scope thereof, it is to be understood that the invention is not limited to the specific embodiments thereof except as defined in the appended claims.

What is claimed is:

1. An assembly for adjusting a lower thread tension for use in combination with a sewing machine having a loop taker and a bobbin carrier which is held by the loop taker and carries therein a bobbin loaded with a lower thread, said assembly comprising (a) a base plate attached to an inner wall of the bobbin carrier and provided with a slit through which the lower thread passes;

(b) a substantially L-shaped presser element having a vertical portion and a horizontal portion, the vertical portion being adapted to be normally pressed against the base plate so as to give a tension to the lower thread passing through the slit;

(c) means for turnably supporting the L-shaped presser element with respect to the base plate;

(d) magnetic means acting on the horizontal portion of the L-shaped presser element without contact thereto for turning the L-shaped presser element; and (e) means for manually operating the magnetic means to vary a magnetic force of the magnetic means with respect to the horizontal portion of the L-shaped presser element.

2. An assembly for adjusting a lower thread tension for use in combination with a sewing machine having a loop taker and a bobbin carrier which is held by the loop taker and carries therein a bobbin loaded with a lower thread, said assembly comprising (a) a base plate attached to an inner wall of the bobbin carrier and provided with a slit through which the lower thread passes;

(b) a resilient member secured to the base plate and being resiliently in contact with the base plate to give a tension to the lower thread passing through the slit;

(c) a substantially L-shaped presser element having a vertical portion and a horizontal portion, the vertical portion being adapted to press the resilient member against the base plate;

(d) means for turnably supporting the L-shaped presser element with respect to the base plate;

(e) magnetic means acting on the horizontal portion of the L-shaped presser element without contact thereto for turning the L-shaped presser element; and (f) means for manually operating the magnetic means to vary the magnetic force of the magnetic means with respect to the horizontal portion of the L-shaped presser element.

3. An assembly according to claim 1 or 2 wherein said magnet means comprises a permanent magnet.

4. An assembly according to claim 1 or 2 wherein said magnet means comprises an electromagnet.

5. An assembly according to claim 1 or 2 wherein said operating means comprises a first rod supporting the magnetic means on one end thereof, a follower pin secured to the other end of the first rod, a grooved cam cooperating with the follower pin to axially move the first rod, and a knob for operating the grooved cam, said knob being located at an accessible part of the sewing machine.

* * * * *